US006634196B2

(12) United States Patent
Huang

(10) Patent No.: US 6,634,196 B2
(45) Date of Patent: Oct. 21, 2003

(54) TUBULAR LOCK DIRECTLY ACTUATABLE BY A KEY

(75) Inventor: Lan-Shi Huang, Kaohsiung (TW)

(73) Assignee: Taiwan Fu Hsing Industry Co., Ltd. (TW)

( * ) Notice: Subject to any disclaimer, the term of this patent is extended or adjusted under 35 U.S.C. 154(b) by 0 days.

(21) Appl. No.: 10/006,234

(22) Filed: Dec. 10, 2001

(65) Prior Publication Data

US 2003/0106355 A1 Jun. 12, 2003

(51) Int. Cl.[7] ..... G05G 5/00; E05B 21/00

(52) U.S. Cl. ..... 70/224; 70/207; 70/210; 70/215; 292/169.17

(58) Field of Search ..... 70/224, 210, 215, 70/207, 216, 467; 292/169.17, 336.3

(56) References Cited

U.S. PATENT DOCUMENTS

| | | | | | |
|---|---|---|---|---|---|
| 5,233,851 | A | * | 8/1993 | Florian | 70/367 |
| 5,301,526 | A | * | 4/1994 | Fann et al. | 70/224 |
| 5,372,025 | A | * | 12/1994 | Lin | 70/472 |
| 5,651,280 | A | * | 7/1997 | Park | 70/472 |
| 5,784,909 | A | * | 7/1998 | Huang | 70/224 |
| 5,916,281 | A | * | 6/1999 | Kester et al. | 70/224 |
| 6,109,080 | A | * | 8/2000 | Chen et al. | 70/371 |
| 6,216,500 | B1 | * | 4/2001 | Kang | 70/224 |
| 6,360,569 | B1 | * | 3/2002 | Huang | 70/215 |
| 6,425,273 | B1 | * | 7/2002 | Kim et al. | 70/224 |
| 6,497,126 | B2 | * | 12/2002 | Wang | 70/472 |
| 6,536,249 | B2 | * | 3/2003 | Wu | 70/467 |
| 2002/0116964 | A1 | * | 8/2002 | Koskela et al. | 70/224 |

FOREIGN PATENT DOCUMENTS

| | | | | |
|---|---|---|---|---|
| GB | 2262770 | A | * 6/1993 | E05B/47/06 |

* cited by examiner

*Primary Examiner*—Anthony Knight
*Assistant Examiner*—Chris Boswell
(74) *Attorney, Agent, or Firm*—Bacon & Thomas, PLLC

(57) ABSTRACT

A tubular lock. The lock can be directly actuated and unlocked by a key and includes an inner lock assembly mounted to an inner side of a door and an outer lock assembly mounted to an outer side of the door. The inner lock assembly includes an inner handle for turning a driving wheel of a latch assembly to retract a latch bolt. The outer lock assembly includes a lock and an actuating member operably connected between a drive member and a lock core of the lock. The driving wheel can be driven by an actuating tube of the drive member to retract the latch bolt.

11 Claims, 4 Drawing Sheets

TUBULAR LOCK DIRECTLY ACTUATABLE BY A KEY

BACKGROUND OF THE INVENTION

1. Field of the Invention

The present invention relates to a lock device for a stockroom. In particular, the present invention relates to a tubular lock that can be directly actuated and unlocked by a key.

2. Description of the Related Art

Taiwan Utility Model Publication No. 202701 issued on Mar. 21, 1993 and entitled "LOCKING MECHANISM FOR A TUBULAR LOCK" discloses a tubular lock comprising an outer handle, a spindle, a plate, a post, and a fixing disc. The tubular lock further comprises an inner handle that has a spindle having a protrusion engaged in a groove of a sleeve. A push button and an actuating tube are mounted in the sleeve. An end of a return spring is attached to an end face of the sleeve, and the other of the return spring is attached to the push button to bias the push button out of the inner handle via an opening in the inner handle. When one is outside the door to which the tubular lock is mounted, a proper key, if the tubular lock is in a locked state, must be used to turn the plate, which, in turn, causes rotation of the actuating tube and returning motion of the push button, thereby unlocking the tubular lock. Then, the outer handle is turned for opening the door.

The operational procedure is troublesome for such a tubular lock, as the key must be used to unlatch the tubular lock and the outer handle must be then turned. Thus, the use of the tubular lock is not convenient, and the tubular lock has a complicated structure.

SUMMARY OF THE INVENTION

It is an object of the present invention to provide a tubular lock that can be directly actuated and unlocked by a key. Namely, the door to which the tubular lock is mounted can be directly unlocked when using the key from outside.

It is another object of the present invention to provide a tubular lock that can be directly actuated and unlocked by a key and that has a simple structure.

A tubular lock can be directly actuated and unlocked by a key and comprises an inner lock assembly mounted to an inner side of a door and an outer lock assembly mounted to an outer side of the door. The inner lock assembly comprises an inner handle for turning a driving wheel of a latch assembly to thereby retract a latch bolt. The outer lock assembly comprises a lock and an actuating member operably connected between a drive member and a lock core of the lock. The driving wheel can be driven by an actuating tube of the drive member to thereby retract the latch bolt.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
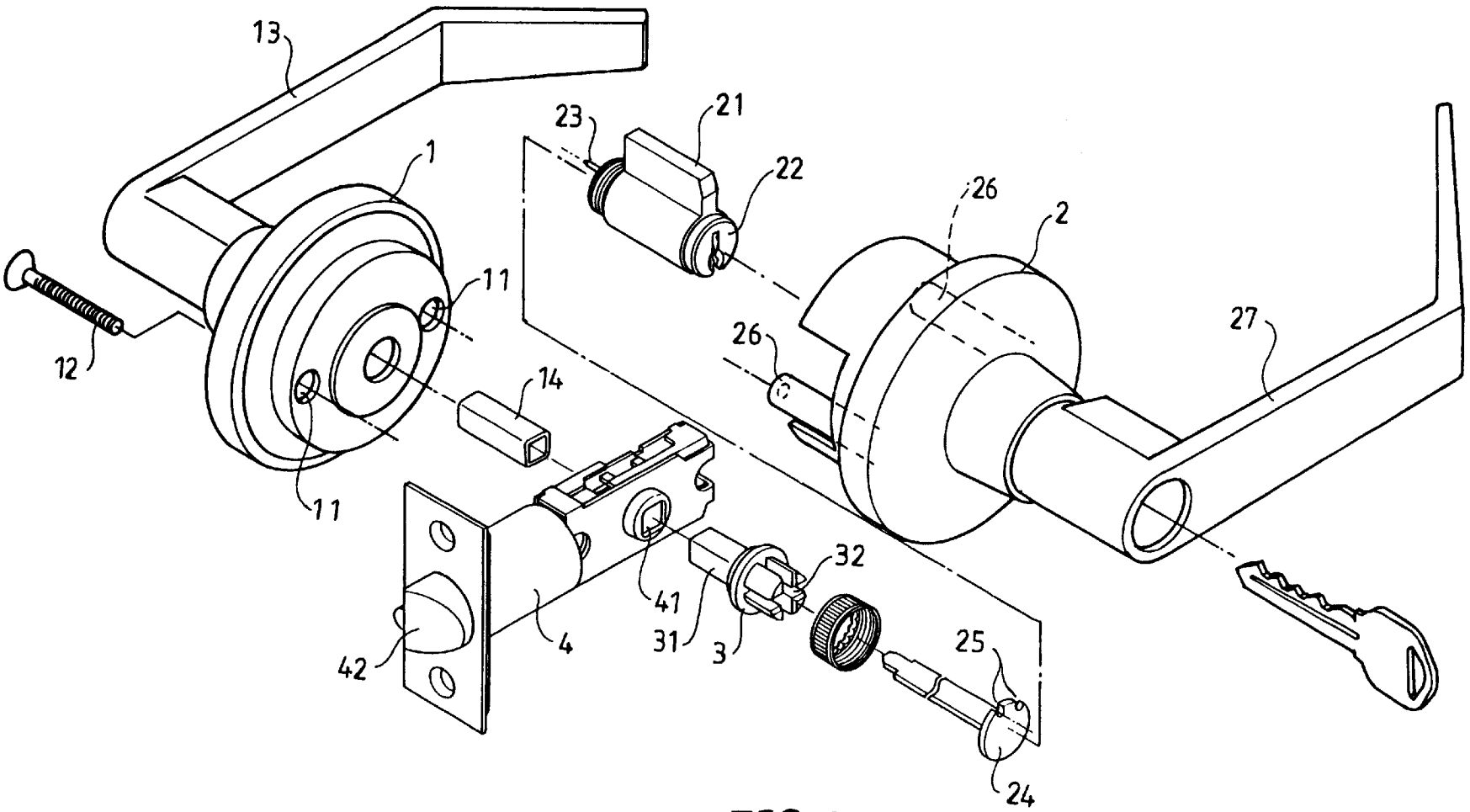
FIG. 1 is an exploded perspective view of a first embodiment of a tubular lock in accordance with the present invention.

Referring to FIG. 1, a first embodiment of a tubular lock in accordance with the present invention generally comprises an inner lock assembly 1, an outer lock assembly 2, and a drive member 3.

The inner lock assembly 1 comprises two positioning holes 11 through which fasteners such as screws 12 are extended to thereby respectively fix the inner lock assembly 1 and the outer lock assembly 2 to an inner side and an outer side of a door. The inner lock assembly 1 is conventional and comprises an inner handle 13 that can be turned and pushed/pulled. When the inner handle 13 is turned, one of two driving wheels 41 of a latch assembly 4 is turned to thereby retract a latch bolt 42. Returning means such as a spring is mounted in the inner lock assembly 1 for returning the inner handle 13.

The outer lock assembly 2 comprises a pair of positioning tubes 26 for engaging with the fasteners 12 so as to be mounted to the outer side of the door. The outer lock assembly 2 comprises a lock 21 into which a proper key is insertable for driving a lock core 22 of the lock 21. The lock core 22 has a tail-piece 23 that is engaged in one of two engaging notches 25 defined in an end of an actuating member 24 such that the actuating member 24 is turned when the key is turned. The other end of the actuating member 24 is securely engaged with the drive member 3 to turn therewith. The outer lock assembly 2 further comprises an outer handle 27 that is not turnable but only pullable/pushable to thereby open/close the door.

The drive member 3 comprises a non-circular actuating tube 31 in an end thereof. The non-circular actuating tube 31 extends through the other driving wheel 41. Thus, when the drive member 3 turns, the other driving wheel 41 is turned to thereby retract the latch bolt 42. An engaging groove 32 is defined in the other end of the drive member 3. The engaging groove 32 may be a rectilinear groove or a cruciform groove shown in FIG. 1. The other end of the actuating member 24 is securely engaged in the engaging groove 32 of the drive member 3 to allow joint rotation of the drive member 3 and the actuating member 24.

Figure 2:
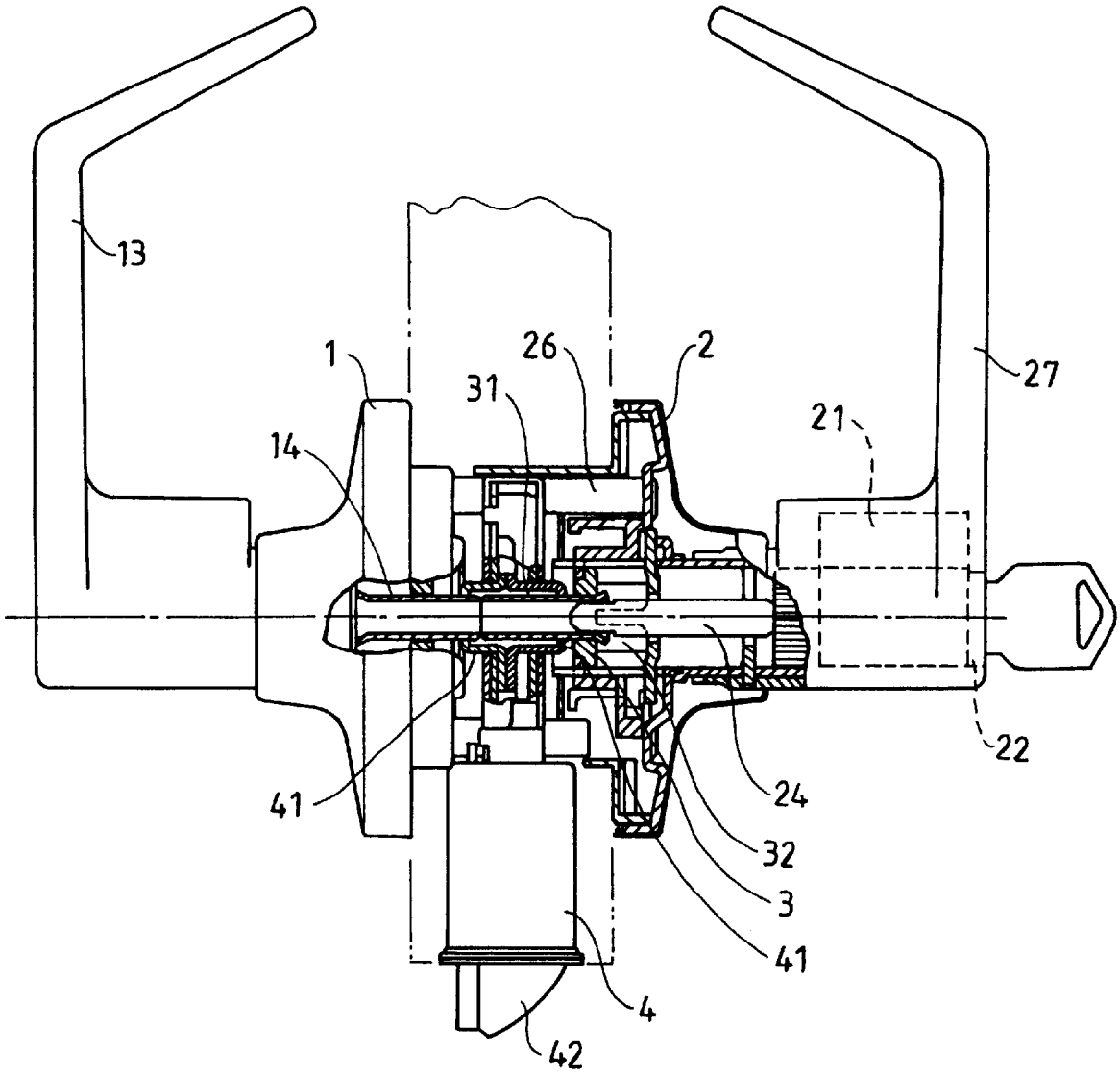
FIG. 2 is a top view, partly sectioned, of the tubular lock in FIG. 1.

As illustrated in FIG. 2 showing the tubular lock after assembly, the driving wheels 41 of the latch assembly 4 can be respectively driven by the spindle 14 and the actuating tube 31. Namely, when either the spindle 14 or the actuating tube 31 is turned, the latch bolt 42 of the latch assembly 4 is retracted. The spindle 14 is driven by the inner handle 13, and the actuating tube 31 is turned by the actuating member 24 engaged with the engaging groove 32 of the drive member 3, while the actuating member 24 is driven by the tail-piece 23 of the lock 21 that is engaged with one of the engaging notches 25 of the actuating member 24. Thus, when a proper key is inserted into and thus turns the lock core 22, the actuating member 24 is turned.

Figure 3:
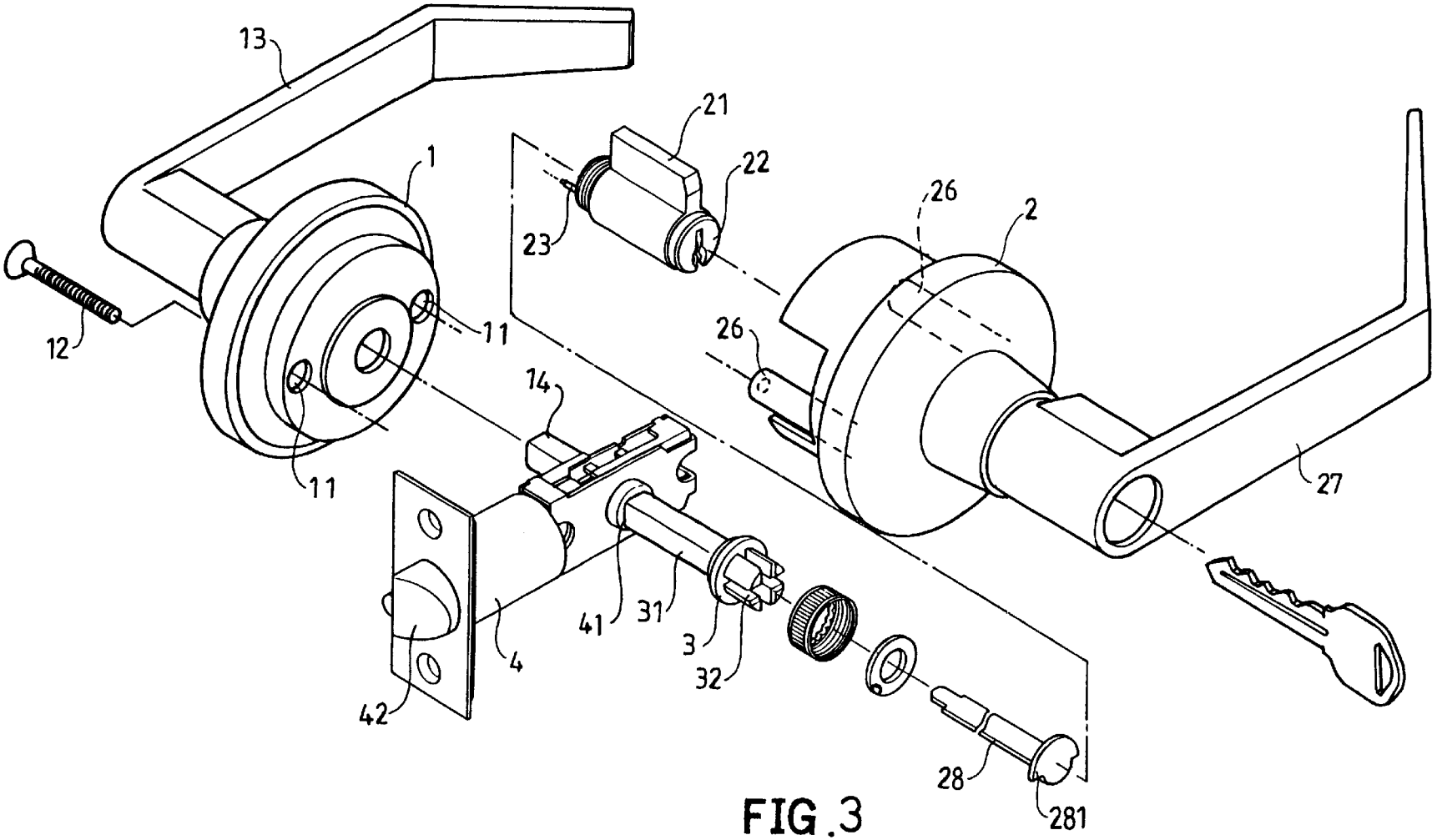
FIG. 3 is an exploded perspective view of a second embodiment of the tubular lock in accordance with the present invention.

FIG. 3 illustrates a second embodiment of the tubular lock in accordance with the present invention. The tubular lock comprises an inner lock assembly 1, an outer lock assembly 2, and a drive member 3.

Similar to the first embodiment, the inner lock assembly 1 comprises two positioning holes 11 through which fasteners such as screws 12 are extended to engage with two positioning tubes 26 of the outer lock assembly 2, thereby respectively fixing the inner lock assembly 1 and the outer lock assembly 2 to an inner side and an outer side of a door. The inner lock assembly 1 comprises an inner handle 13 that can be turned and pushed/pulled. When the inner handle 13 is turned, a non-circular actuating tube 31 extending through a driving wheel 41 of a latch assembly 4 is turned. Thus, the driving wheel 41 is turned to thereby retract a latch bolt 42. Returning means such as a spring is mounted in the inner lock assembly 1 for returning the inner handle 13.

The outer lock assembly 2 comprises a lock 21 having a lock core 22 into which a proper key is insertable for driving the lock core 22 of the lock 21. The lock core 22 has a tail-piece 23 that abuts against a side of a sector-like plate 281 formed on an end of an actuating member 28 such that the actuating member 28 is turned when the key is turned. In this embodiment, the sector-like plate 281 is comprised of a half circle of a relatively smaller diameter on one half thereof and a half circle of a relatively larger diameter on the other half thereof, best shown in FIG. 3. The other end of the actuating member 28 is securely engaged with an engaging groove 32 of the drive member 3 to turn therewith. Thus, when the lock core 22 is turned, the drive member 3 is directly driven. The sector-like plate 281 is so configured that the tail-piece 23 of the lock core 22 is not actuated when the inner handle 13 is turned and thus causes rotation of the drive member 3. Thus, the actuating plate 28 will not turn the lock core 22 when the inner handle 13 is turned.

The drive member 3 comprises a non-circular actuating tube 31 in an end thereof. The non-circular actuating tube 31 extends through the driving wheel 41 and is securely engaged with a spindle 14 mounted on the inner handle 13. An engaging groove 32 is defined in the other end of the drive member 3. The engaging groove 32 may be a rectilinear groove or a cruciform groove shown in FIG. 3. The other end of the actuating member 28 is securely engaged in the engaging groove 32 of the drive member 3 to allow joint rotation of the drive member 3 and the actuating member 28.

Figure 4:
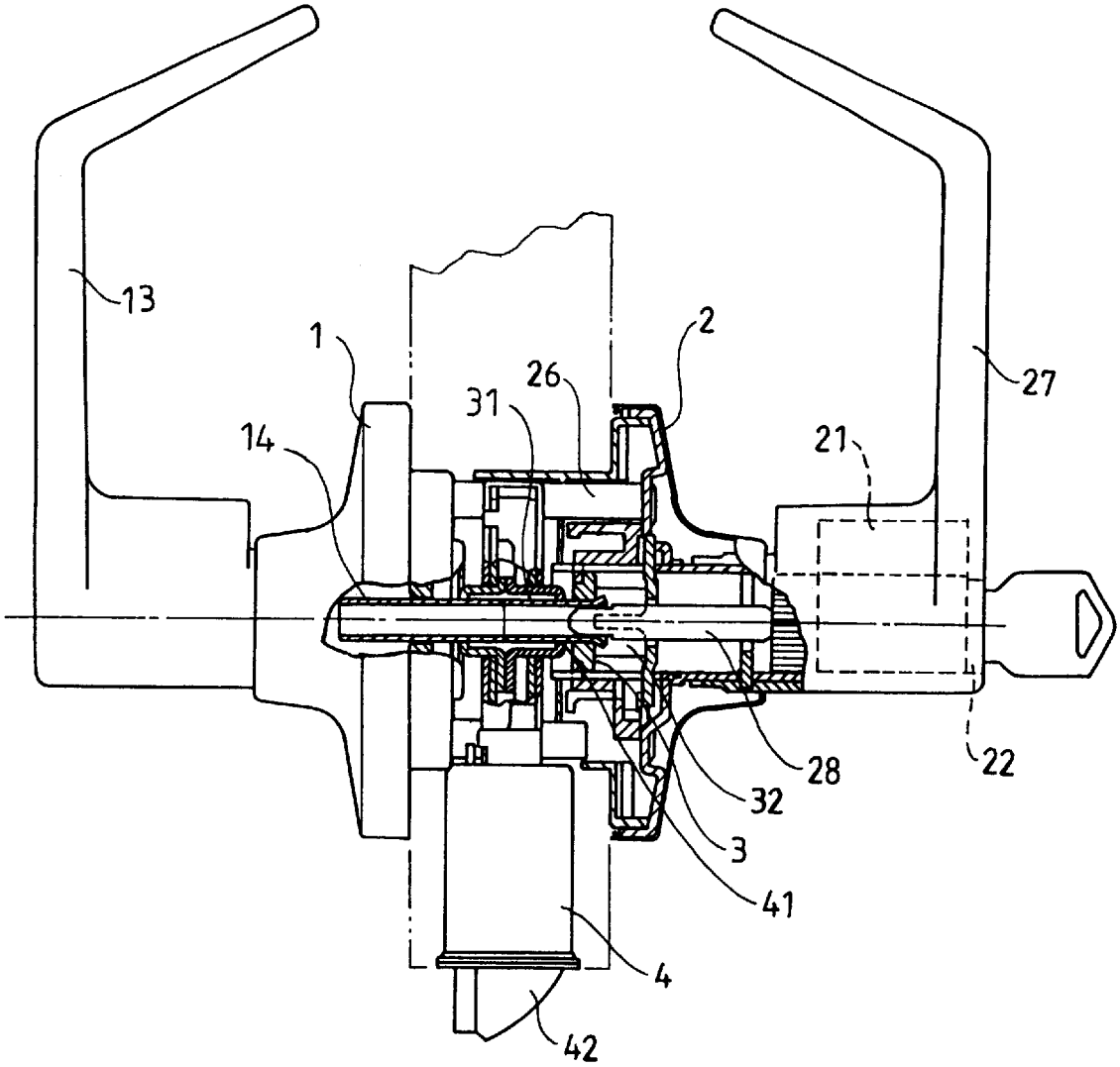
FIG. 4 is a top view, partly sectioned, of the tubular lock in FIG. 3.

After assembly, the inner lock assembly 1 and the outer lock assembly 2 are respectively mounted to the inner side and the outer side of the door, as shown in FIG. 4. When the inner handle 13 is turned, the actuating tube 31 of the drive member 3 is turned. As a result, the latch bolt 42 of the latch assembly 4 is retracted. It is noted that the tail-piece 23 of the lock core 22 is not actuated by the actuating member 28 when the drive member 31 turns. When one is outside the door and intends to open the door in a locked state, a proper key is inserted into the lock core 22 and turned through a predetermined angle, the tail-piece 23 of the lock core 22 urges the actuating member 28 to turn, which in turn, causes rotation of the drive member 3. The latch bolt 42 of the latch assembly 4 is thus retracted. In this embodiment, the latch assembly 4 may include two driving wheels 41 that are driven by either the actuating tube 31 of the drive member 3 or the spindle 14 attached to the inner handle 13.

According to the above description, it is appreciated that the tubular lock in accordance with the present invention has a simple structure and can be directly unlocked by a key from outside. Namely, the latch bolt 42 of the latch assembly 4 is directly retracted when the key is inserted into the lock core 22 and then turned. One may directly pull and thus open the door without turning the outside handle 27. In addition, since the outside handle 27 does not have to turn, the structure of the outer lock assembly 2 can thus be simplified. Accordingly, the tubular lock in accordance with the present invention has a simple structure when compared with conventional tubular locks.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A tubular lock comprising:

a latch assembly comprising a latch bolt and two driving wheels operably connected to the latch bolt, the latch bolt being retracted when either one of the driving wheels is turned;

an inner lock assembly adapted to be mounted to an inner side of a door, the inner lock assembly comprising an inner handle and a spindle connected to the inner handle to turn therewith, the spindle being engaged with one of the driving wheels to turn therewith such that said one of the driving wheels is turned to thereby retract the latch bolt when the inner handle is turned;

an outer lock assembly adapted to be mounted to an outer side of the door, the outer lock assembly comprising an outer fixed handle which is unable to turn in both a locked state and an unlocked state, a lock, and an actuating member, the lock comprising a lock core having a tail-piece, the lock core being driven by a proper key to turn the actuating member; and a drive member, the drive member comprising an actuating tube being engaged with the other one of the driving wheels to turn therewith, the drive member being securely engaged with the actuating member to turn therewith such that the other driving wheel is only allowed to turn from an outer side thereof on condition that when the proper key is inserted into the lock core and turned.

2. The tubular lock as claimed in claim 1, wherein the drive member comprises an engaging groove configured for securely engaging with an end of the actuating member.

3. The tubular lock as claimed in claim 2, wherein the engaging groove is a rectilinear groove or a cruciform groove.

4. The tubular lock as claimed in claim 1, wherein the actuating member comprises two engaging notches in another end thereof.

5. The tubular lock as claimed in claim 1, wherein the actuating member comprises a sector-like plate on another end thereof, the sector-like plate being comprised of a half circle of a relatively smaller diameter on one half thereof and a half circle of a relatively larger diameter on the other half thereof.

6. The tubular lock as claimed in claim 5, wherein the sector-like plate is so configured that the tail-piece of the lock core is not actuated when the drive member and the actuating member are turned as a result of turning of the inner handle.

7. A tubular lock comprising:

a latch assembly comprising a latch bolt and a driving wheel operably connected to the latch bolt, the latch bolt being retracted when the driving wheel is turned;

an inner lock assembly adapted to be mounted to an inner side of a door, the inner lock assembly comprising an inner handle operably connected to the driving wheel to turn therewith such that the driving wheel is turned to thereby retract the latch bolt when the inner handle is turned;

an outer lock assembly adapted to be mounted to an outer side of the door, the outer lock assembly comprising an outer fixed handle which is unable to turn in both a locked state and an unlocked state, a lock, and an actuating member, the lock comprising a lock core having a tail-piece, the lock core being driven by a proper key to turn the actuating member; and a drive member, the drive member comprising an actuating tube being engaged with the driving wheel to turn therewith, the drive member being securely engaged with the actuating member to turn therewith such that the driving wheel is only allowed to turn from an outer side thereof on condition that the proper key is inserted into the lock core and turned.

8. The tubular lock as claimed in claim 7, wherein the drive member comprises an engaging groove for securely engaging with an end of the actuating member.

9. The tubular lock as claimed in claim 8, wherein the engaging groove is a rectilinear groove or a cruciform groove.

10. The tubular lock as claimed in claim 8, wherein the actuating member comprises a sector-like plate on another end thereof, the sector-like plate being comprised of a half circle of a relatively smaller diameter on one half thereof and a half circle of a relatively larger diameter on the other half thereof.

11. The tubular lock as claimed in claim 10, wherein the sector-like plate is so configured that the tail-piece of the lock core is not actuated when the drive member and the actuating member are turned as a result of turning of the inner handle.

* * * * *